US007633216B2

(12) United States Patent
Sommerer

(10) Patent No.: US 7,633,216 B2
(45) Date of Patent: Dec. 15, 2009

(54) BARIUM-FREE ELECTRODE MATERIALS FOR ELECTRIC LAMPS AND METHODS OF MANUFACTURE THEREOF

(75) Inventor: Timothy John Sommerer, Ballston Spa, NY (US)

(73) Assignee: General Electric Company, Niskayuna, NY (US)

( * ) Notice: Subject to any disclaimer, the term of this patent is extended or adjusted under 35 U.S.C. 154(b) by 49 days.

(21) Appl. No.: 11/288,510

(22) Filed: Nov. 28, 2005

(65) Prior Publication Data

US 2007/0120456 A1 May 31, 2007

(51) Int. Cl.
*H01J 19/06* (2006.01)

(52) U.S. Cl. ..... 313/311

(58) Field of Classification Search ..... 313/311, 313/627–643, 310; 252/500–521.6
See application file for complete search history.

(56) References Cited

U.S. PATENT DOCUMENTS

| | | | | |
|---|---|---|---|---|
| 2,855,264 | A | 10/1958 | Delrieu | |
| 3,519,865 | A * | 7/1970 | Weston | 313/43 |
| 3,748,517 | A * | 7/1973 | Haft | 313/487 |
| 4,132,916 | A * | 1/1979 | Hueschen et al. | 378/144 |
| 4,319,158 | A * | 3/1982 | Watanabe et al. | 313/346 R |
| 5,138,224 | A | 8/1992 | Goldburt et al. | |
| 5,585,694 | A | 12/1996 | Goldburt et al. | |
| 5,817,597 | A * | 10/1998 | Carolan et al. | 502/400 |
| 5,854,152 | A * | 12/1998 | Kohli et al. | 501/70 |
| 5,864,209 | A * | 1/1999 | Clark | 313/622 |
| 5,883,462 | A * | 3/1999 | Ushifusa et al. | 313/292 |
| 5,962,977 | A | 10/1999 | Matsumoto et al. | |
| 6,172,453 | B1 | 1/2001 | Hamada et al. | |
| 6,680,574 | B1 * | 1/2004 | Gaertner et al. | 313/633 |
| 6,879,091 | B2 * | 4/2005 | Venugopal et al. | 313/311 |
| 2002/0058737 | A1 * | 5/2002 | Nishiwaki et al. | 524/431 |
| 2004/0051436 | A1 * | 3/2004 | Kawai | 313/346 DC |
| 2005/0073261 | A1 * | 4/2005 | Takeuchi et al. | 315/169.1 |
| 2005/0116639 | A1 | 6/2005 | Son et al. | |
| 2005/0117192 | A1 * | 6/2005 | Enomoto et al. | 359/265 |
| 2007/0003743 | A1 * | 1/2007 | Asano et al. | 428/201 |

FOREIGN PATENT DOCUMENTS

| | | | |
|---|---|---|---|
| EP | 0159741 | A1 | 10/1985 |
| EP | 0466138 | B1 | 1/1992 |
| EP | 0489463 | B1 | 6/1992 |
| EP | 0584858 | A1 | 3/1994 |
| EP | 0643416 | A1 | 3/1995 |
| GB | 2051470 | A | 1/1981 |
| WO | WO2004/025687 | A2 | 3/2004 |
| WO | WO2005/015601 | A2 | 2/2005 |

OTHER PUBLICATIONS

PCT International Search Report dated Apr. 29, 2008.

* cited by examiner

*Primary Examiner*—Toan Ton
*Assistant Examiner*—Hana A Sanei
(74) *Attorney, Agent, or Firm*—Mary Louise Gioeni

(57) ABSTRACT

A barium-free electron emissive material comprises a barium-free metal oxide composition and operable to emit electrons on excitation. A lamp including an envelope, an electrode including a barium-free electron emissive material and a discharge material, is also disclosed.

13 Claims, 7 Drawing Sheets

BARIUM-FREE ELECTRODE MATERIALS FOR ELECTRIC LAMPS AND METHODS OF MANUFACTURE THEREOF

BACKGROUND

Embodiments of the invention generally to electron emissive materials and in particular to barium-free electron emissive materials for electric plasma discharge devices.

Low-pressure metal halide electric discharge plasmas have the potential to replace the mercury-based electric discharge plasma used in conventional fluorescent lamps. However, many known electron emission materials in conventional lamps are not chemically stable in the presence of metal halide plasma. Electron-emissive mixtures containing barium oxide have been typically used in mercury discharge lamps. However, the use of barium oxide in metal halide discharge lamps poses certain challenges. The use of barium oxide as a component of lamp electrodes, especially in low-pressure metal halide discharge lamps, is expected to lead to performance issues. This is at least in part due to the reaction of the metal halide with barium oxide, which can lead to the formation of barium halide and a condensed metal oxide. For example, a metal halide discharge material such as indium bromide may react with an electrode material such as barium oxide to form barium bromide and indium oxide. Such a reaction would lead to a direct reduction in light emitting discharge material present in the discharge plasma. It is therefore advantageous to avoid such deleterious reactions in discharge lamps involving the metal halide emission material, as it may lead to a reduction in life of the lamp.

In conventional fluorescent mercury lamps, due to reactivity problems with components of the electron emissive material such as barium, some amount of mercury may be effectively removed from the discharge medium and hence cannot not contribute to radiation emission. For example, barium in a barium-strontium-calcium triple oxide electron emissive material may amalgamate with mercury in the discharge medium leading to a reduction in the amount of mercury available for radiation emission. To compensate for such loss, higher dosages of mercury, sometimes up to 10 to 50 times higher mercury dosage than the 0.1 mg of mercury typically required, is used to ensure adequate availability of mercury through the life of the lamp.

BRIEF DESCRIPTION

One aspect of the present invention includes a barium-free metal oxide composition including a barium-free metal oxide operable to emit electrons in response to a thermal excitation, wherein the metal oxide is selected from the group consisting of calcium oxide, strontium oxide, magnesium oxide and combinations thereof.

Another aspect of the present invention includes a barium-free electron emissive material, wherein the barium-free electron emissive material includes at least one barium-free metal oxide composition operable to emit electrons in response to a thermal excitation, wherein the metal oxide is selected from the group consisting of calcium oxide, strontium oxide, magnesium oxide, and combinations thereof.

Yet another aspect of the present invention includes a lamp including an envelope, an electrode comprising a barium-free electron emissive material, wherein the barium-free electron emissive material comprises at least one barium-free metal oxide composition operable to emit electrons in response to a thermal excitation, wherein the metal oxide is at least selected from the group consisting of calcium, strontium, magnesium and combinations thereof and a discharge material contained within the envelope.

A further aspect of the present invention includes a method of manufacturing a barium-free electron emissive system including blending a precursor electron emissive material including a barium-free metal oxide composition with a binder to form a slurry, wherein the barium-free metal oxide composition includes at least one barium-free metal oxide selected from the group consisting of calcium, strontium, magnesium and combinations thereof, coating the slurry on a thermal or electrical excitation source, activating the electron emissive material.

A still further aspect of the present invention includes a method of operating a lamp including thermally exciting a barium-free electron emissive material including a barium-free metal oxide composition disposed within a lamp by operably coupling the electron emissive material to an excitation source and supplying thermal energy to cause the barium-free electron emissive material to emit electrons, wherein barium-free metal oxide composition comprises at least one metal oxide selected from the group consisting of calcium, strontium, magnesium and combinations thereof, wherein the barium-free metal oxide composition is barium-free.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

It is generally considered desirable for thermionic electron emitters to have a combination of low work function, for example, less than about 5 eV and high operating temperature, for example, greater than 1000° C. Barium oxide has long been considered as a primary electron emissive material candidate for use in lamp electrodes. Alkaline earth oxide mixtures, such as but not limited to alkaline earth triple oxide mixtures, typically include at least some amount of barium oxide. Embodiments of the present invention include a barium-free composition, including a barium-free metal oxide composition operable to emit electrons in response to a thermal excitation. Such thermal excitation may be provided by external heating or by the discharge plasma itself or a combination of the both.

As used herein, the term "barium-free metal oxide composition" refers to any composition that includes at least one metal oxide (e.g., such as calcium oxide, strontium oxide, or magnesium oxide or any combinations thereof) and does not include any barium, whereby all reasonable measures have been taken to avoid the presence of barium. The term "metal oxide" as used herein refers to calcium oxide, strontium oxide, or magnesium oxide or any combinations thereof. In certain embodiments, a barium-free metal oxide composition may include one or more metal oxides such as calcium oxide (CaO), strontium oxide (SrO), or magnesium oxide (MgO) or combinations thereof. Barium-free metal oxide compositions described herein may be configured to emit electrons in response to various excitations such as, but not limited to thermal excitation and electrical excitation.

Figure 1:
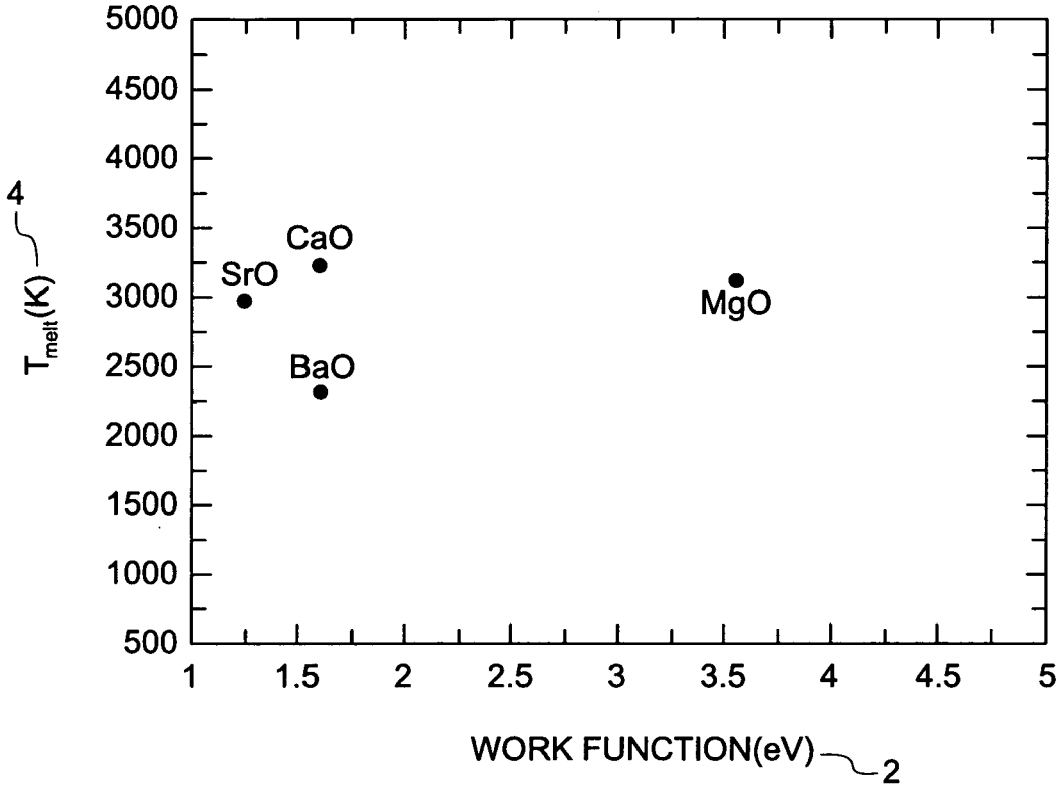
FIG. 1 is a graphical representation of the dependence of melting point temperature vs. work function for magnesium oxide, calcium oxide, strontium oxide, and barium oxide.

FIG. 1 is a graphical representation of work functions 2 vs. melting temperatures 4 for magnesium oxide, calcium oxide, strontium oxide, and barium oxide. As shown below, Table 1 summarizes the plotted values of work function and melting temperatures for magnesium oxide, calcium oxide, strontium oxide, and barium oxide. As illustrated in FIG. 1 and Table 1, calcium oxide has a higher melting temperature and a similar work function as compared to barium oxide, whereas strontium oxide has a higher melting temperature and a lower work function as compared to barium oxide. Also, simple thermodynamic estimates of vapor pressure for halides of calcium, strontium and magnesium in the presence of a halogen vapor points to lesser reactivity of magnesium oxide, calcium oxide, and strontium oxide, as compared to barium oxide in halogen vapor. In one embodiment of the present invention a barium-free metal oxide composition including calcium oxide, strontium oxide, or magnesium oxide, or any combinations thereof, is provided, wherein the barium-free metal oxide composition has a low work function and is stable during thermionic operation in the presence of a discharge plasma containing metal halides.

TABLE 1

Work function Vs. Melting temperature

| Alkaline earth Oxide | Work Function (eV) | Melting temperature (° C.) |
|---|---|---|
| MgO | 3.55 | 3105 |
| CaO | 1.6 | 3200 |
| SrO | 1.25 | 2938 |
| BaO | 1.6 | 2286 |

In one embodiment, a barium-free metal oxide composition of the present invention may be of formula MO, where 'M ' represents magnesium (Mg), calcium (Ca), or strontium (Sr), or any combinations thereof. Likewise, for the purposes of the following description, M is intended to represent magnesium (Mg), calcium (Ca), or strontium (Sr), or any combinations thereof. In a non-limiting example, the barium-free metal oxide composition may be CaO, where the metal M is wholly calcium. In another non-limiting example, the barium-free metal oxide composition may be $Ca_{0.5}Sr_{0.4}Mg_{0.1}O$, where M is in part calcium, in part strontium and in part magnesium.

In some embodiments, a barium-free metal oxide composition of the present invention may be stoichiometrically charge balanced. Charge balancing provides that there may be no net charge on the barium-free metal oxide composition. In some other embodiments, the barium-free metal oxide composition may be non-stoichiometric. For example, the barium-free metal oxide composition may have some oxygen deficiency such that the resulting excess metal may act as a dopant and provide increased electrical conductivity.

In some embodiments, a barium-free metal oxide composition may include calcium oxide. In some embodiments, calcium oxide may be present in a quantity greater than 20% by weight of the total barium-free metal oxide composition. In other embodiments, calcium oxide may be present in a quantity greater than 50% by weight of the total barium-free metal oxide composition. In still other embodiments, calcium oxide may be present in a quantity greater than 80% by weight of the total barium-free metal oxide composition.

In some embodiments a barium-free metal oxide composition of the present invention may include strontium oxide. In some embodiments, strontium oxide may be present in a quantity greater than 20% by weight of the total barium-free metal oxide composition. In other embodiments, strontium oxide may be present in a quantity greater than 50% by weight of the total barium-free metal oxide composition. In yet other embodiments, strontium oxide may be present in a quantity greater than 80% by weight of the total barium-free metal oxide composition.

In some embodiments a barium-free metal oxide composition of the present invention may include magnesium oxide. In some embodiments, magnesium oxide may be present in a quantity greater than 10% by weight of the total barium-free metal oxide composition. In other embodiments, magnesium oxide may be present in a quantity greater than 20% by weight of the total barium-free metal oxide composition. In yet other embodiments, magnesium oxide may be present in a quantity greater than 30% by weight of the total barium-free metal oxide composition. In one embodiment, magnesium oxide may be used to provide stability and robustness to the barium-free metal oxide composition. For example, when used in a lamp electrode, the magnesium oxide brings stability to the lamp. This may be especially true during lamp starting, when the electron emission material is still below the temperature where significant thermionic emission occurs. Magnesium oxide also has a high secondary electron emission coefficient (number of electrons released per incident ion) and therefore is a relatively good source of electrons when bombarded by energetic (>20 eV) ions. Although the applicants do not wish to be bound by any particular theory, during the starting phase of lamp operation, when the electron emissive material is still not hot enough for significant thermionic emission and the discharge plasma tries to extract electrons from the electron emissive material, magnesium oxide, because of its high secondary electron emission coefficient, can supply the required electron current in response to incident ions of relatively low energy, compared to materials with a low secondary electron emission coefficient. Thus, the discharge cathode fall can be lower, leading to lower kinetic energy of the incoming ions and thereby less damage to the electrode due to incident ions.

In some embodiments, a barium-free metal oxide composition of the present invention may be a solid solution of two or more metal oxides. For example, the barium-free metal oxide composition may be a solid solution of a first metal oxide and a second metal oxide, wherein the first and second metal oxide are different from each other and are selected from the group consisting of calcium oxide, strontium oxide, magnesium oxide and combinations thereof. In some embodiments, a weight percent ratio in the barium-free metal oxide composition of the first metal oxide to the second metal oxide may be in a range from about 90:10 to about 10:90. In some other embodiments, a weight percent ratio in the barium-free metal oxide composition of the first metal oxide to the second metal oxide may be in a range from about 70:30 to about 30:70. In certain embodiments, a weight percent ratio in the barium-free metal oxide composition of the first metal oxide to the second metal oxide may be in a range from about 60:40 to about 40:60. The amount of various components in the solid solutions may be chosen to select a certain level of overall chemical activity, and specifically the vapor pressure, of the substances in the solution.

A barium-free metal oxide composition as provided in accordance with certain aspects of the present invention may be operable to emit electrons in response to a thermal and/or an electrical excitation. Thermal excitation leading to thermionic emission is the process by which materials emit electrons or ions upon application of heat. The work function of a material plays a role in determining the level of electron emission for a given thermal excitation. In some embodiments, the barium-free metal oxide composition may also be capable of field emission. Field emission is a form of quantum tunneling in which electrons pass through a barrier in the presence of a high electric field. In some embodiments, the barium-free metal oxide composition may be capable of thermal and field emission concurrently.

As alluded to earlier, a barium-free metal oxide composition may comprise a portion of a barium-free electron emissive material provided on an electrode for use within a lamp. As used herein, the term "barium-free electron emissive material" refers to any barium-free material that includes at least such barium-free metal oxide composition as described herein, wherein the metal oxide is calcium oxide, strontium oxide, or magnesium oxide or any combinations thereof. Use of such barium-free electron emissive materials may be advantageous in systems where such materials do not react with other materials, especially discharge materials, present in the system to unfavorably alter properties of the system. In particular, such a barium-free electron emissive material may be especially useful as an electron emitter material in lamps. The barium-free electron emissive material may be provided on an electrode in a number of ways including, for example, through a wet application. In one embodiment, barium-free electron emissive material may be provided on a hot cathode electrode. During lamp operation the hot cathode is heated to the "thermionic emission temperature" (e.g., the temperature at which electrons are emitted) of the barium-free electron emissive material to provide a source of electrons to support a discharge arc. Hot cathode electrodes may be used in "preheat" "rapid-start" and "instant start" lamp igniting configurations.

Typically in a preheat lamp igniting configuration, electrodes are heated to their emission temperature prior to ignition of the lamp by a pre-heat current. Typically a starting circuit in the lamp sends increased current through the electrodes to heat the filament electrodes. In one example, as the heater current is switched off, the lamp experiences a spike in voltage which may help ignite a discharge arc between the electrodes. The temperature necessary for free emission of electrons is maintained after ignition by incident ions from the discharge.

In a rapid start lamp igniting configuration, ballasts are used to ignite the lamps by simultaneously providing a cathode voltage (to provide heat) and an ignition voltage across the lamp. As the cathodes heat up, the voltage required to ignite the lamp is reduced. At some time after both voltages are applied, the cathodes reach a temperature sufficient for the applied voltage to ignite the lamp.

In an instant start lamp igniting configuration, an initial voltage many times greater than the lamp's normal operating voltage and greater than the lamp's break-down resistance is applied. The starting voltage is sometimes as high as 900 V, high enough to break down the discharge material to enable current conduction.

In one embodiment of the present invention, the electrical conductivity of a barium-free metal oxide composition may be enhanced by imperfections in the material, such as but not limited to the reduction of the barium-free metal oxide composition (MO) to metallic M (once again where 'M' represents magnesium (Mg), calcium (Ca), or strontium (Sr), or any combinations thereof), and by creation of lattice vacancies. In some embodiments, a monolayer of M may form on the surface of the barium-free electron emissive material including MO. In some further embodiments, the metal in the M monolayer and the M in the metal oxide MO are different. Additionally, the work function of such a composite arrangement may be lower than that of either metallic M or MO taken individually. In other embodiments an M monolayer may form on exposed portions of a supporting substrate, and the work function of such a composite arrangement may be lower than either metallic M or the supporting substrate taken individually. The supporting substrate may be chosen to be chemically inert with the barium-free electron emissive material, or it may be chosen to promote a desirable reaction with the barium-free electron emissive material. Common substrate materials include high-temperature metals such as but not limited to tungsten, tantalum, and platinum. In one embodiment, a barium-free electron emissive material may react with the substrate to form metal M from the metal oxide MO.

In some embodiments, a barium-free electron emissive material of the present invention may further include metals or metal alloys. Examples of such metals include but are not limited to tantalum, tungsten, thorium, titanium, nickel, platinum, vanadium, hafnium, niobium, molybdenum, and zirconium. In some embodiments, metals, and metal alloys may be used as substrate materials. In certain other embodiments, a barium-free metal oxide composition may be used along with a metal such as a refractory metal to form a sintered composite. Refractory metals are a class of metals resistant to heat, wear and corrosion and generally have melting points greater than 1800° C.

In a further embodiment of the present invention, a barium-free electron emissive material of the present invention may include a barium-free metal oxide composition and at least one additive material (also referred to herein as an "electron emissive additive material"). Additive materials, for example, may be used as part of the barium-free electron emissive material to enable higher operational temperatures, or to enhance electron emission or to increase stability of the material or to reduce end darkening. In some embodiments, additive materials themselves may be electron emissive, however they need not be.

In a further embodiment, tantalates may be used as an electron emissive additive material. Examples of tantalates include but are not limited to $M_6Ta_2O_{11}$, $M_4Ta_2O_9$, $M_5Ta_4O_{15}$, $MTa_2O_6$, $M_4Ta_4O_{14}$, $MBi_2Ta_2O_9$, $MBi_2NaTa_3O_{12}$,$M(Mg_{1/3}Ta_{2/3})O_3$, $M(Co_{1/3}Ta_{2/3})O3$, $M_6ZrTa_4O_{18}$, $M_3CaTa_2O_9$, and $M(Zn_{1/3}Ta_{2/3})O_3$.

In a further embodiment, ferroelectric oxides may be used as electron emissive additive materials. Ferroelectric oxide additive materials present in the barium-free electron emissive material may facilitate strong electron emission due to their ability to generate electrostatic charges on their polar faces. Ferroelectric oxides are characterized by high spontaneous polarization and generally contribute significantly to the electron emission through the generation of uncompensated electrostatic charges. These charges are created when their spontaneous polarization is disturbed from its equilibrium state under a pyroelectric effect, piezoelectric effect or polarization switching effect. Non-limiting examples of ferroelectric oxides include lead zirconate (PT), lead zirconate titanate (PZT), lead lanthanum zirconium titanate (PLZT) family of ferroelectrics, ferroelectric tungsten bronzes, layer-structured ferroelectrics, ferroelectric perovskites, relaxor-type ferroelectrics, ferroelectric phosphates, oxynitride perovskites, $Pb_5Ge_3O_{11}$, gadolinium molybdate, ferroelectric niobates such as $LiNbO_3$, lead magnesium niobate titanate, lead zirconate vanadates, lead zirconate niobate, lead zirconate tantalate, lead zirconate titanate, lithium niobate, lithium tanatalate, bismuth containing layered structured ferroelectric of the Aurivillius family such bismuth titanate, bismuth strontium tantalate, and combinations thereof.

In yet another embodiment of the present invention, other oxide compositions, in addition to the barium-free metal oxide composition, may be used as electron emissive additive materials. Non-limiting examples of such oxides include aluminum oxide, yttrium oxide, tungsten oxide, lanthanam oxide, thorium oxide, zirconium oxide, yttrium-zirconium-hafnium triple oxide, and zinc oxide.

In some embodiments, a barium-free metal oxide composition of the present invention may be present in a range from about 1% to about 100% by weight of the total barium-free electron emissive material. In other embodiments, the barium-free metal oxide composition may be present in a range from about from about 25% to about 75% by weight of the total barium-free electron emissive material. In certain other embodiments the metal oxide may be present in a range from about 40% to about 60% by weight of the total barium-free electron emissive material.

Various embodiments of electrodes are depicted in the FIGS. 2-6. These embodiments illustrate how barium-free electron emissive materials such as those described herein may be utilized in various cathode configurations. The applications of the barium-free electron emissive materials described herein are not intended to be limited to the depicted embodiments.

Figure 2:
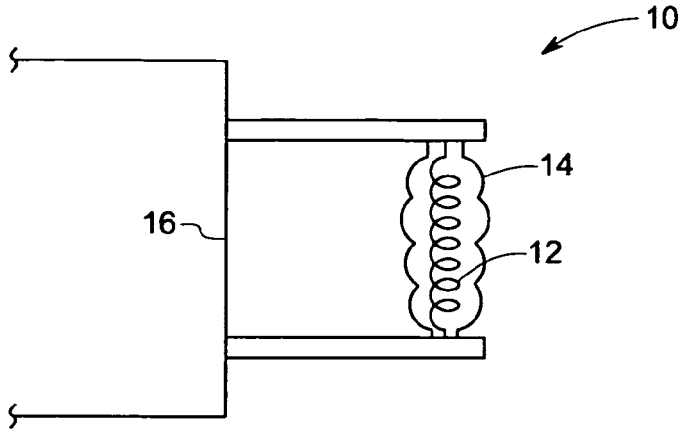
FIG. 2 is a side cross-sectional view of a coil electrode having a barium-free electron emissive material in accordance with certain embodiments of the present invention.
Figure 3:
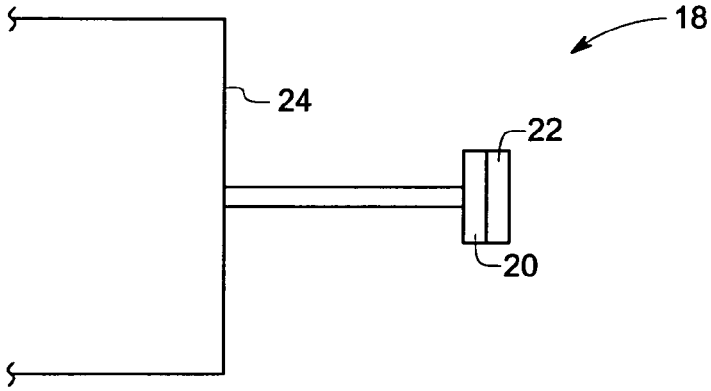
FIG. 3 is a side cross-sectional view of a flat member cathode having a barium-free electron emissive material in accordance with certain embodiments of the present invention.
Figure 4:
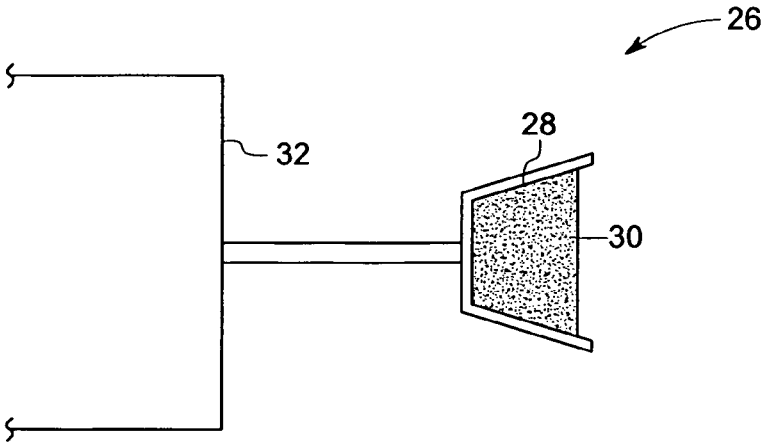
FIG. 4 is a side cross-sectional view of a cup shaped cathode having a barium-free electron emissive material in accordance with certain embodiments of the present invention.

As illustrated in FIG. 2, the cathode 10 may comprise a metal wire or a metal coil 12, such as a tungsten coil, with a barium-free electron emissive material coating 14, coupled to ballast 16. Ballasts are typically used to provide and regulate the necessary electric current through the discharge and through the electrode. Alternatively as shown in FIG. 3, the cathode 18 may comprise a flat component 20 containing the barium-free electron emissive material 22 (such as in the form of a coating) on at least one surface coupled to ballast 24. In the illustrated embodiment shown in FIG. 4, the cathode 26 includes a cup shaped structure 28 containing the barium-free electron emissive material 30 inside the hollow interior space of the cup. In some embodiments, the barium-free electron emissive material 30 may be operably coupled to the cup shaped structure 28 by sintering the cup 28 and the material 30 together. The cathode may be further coupled to ballast 32.

Figure 5:
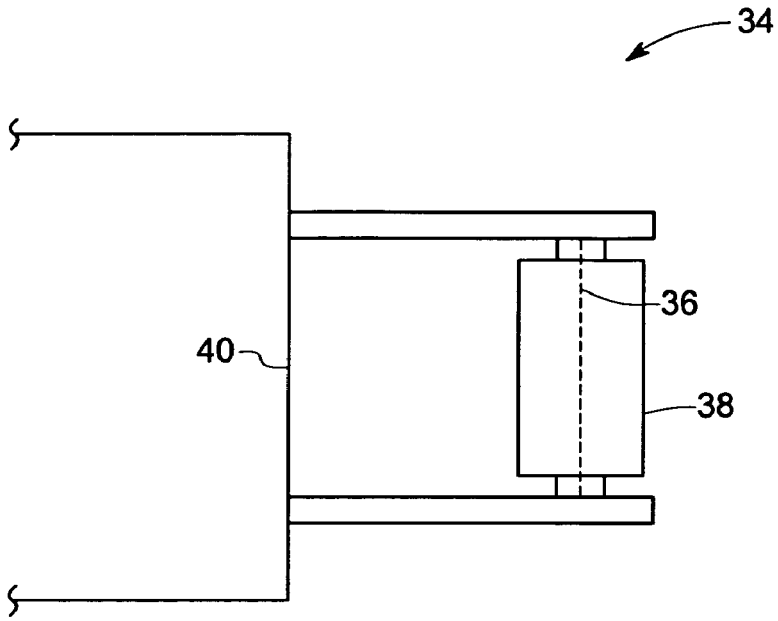
FIG. 5 is a side cross-sectional view of a cathode having a barium-free electron emissive material in accordance with certain embodiments of the present invention.
Figure 6:
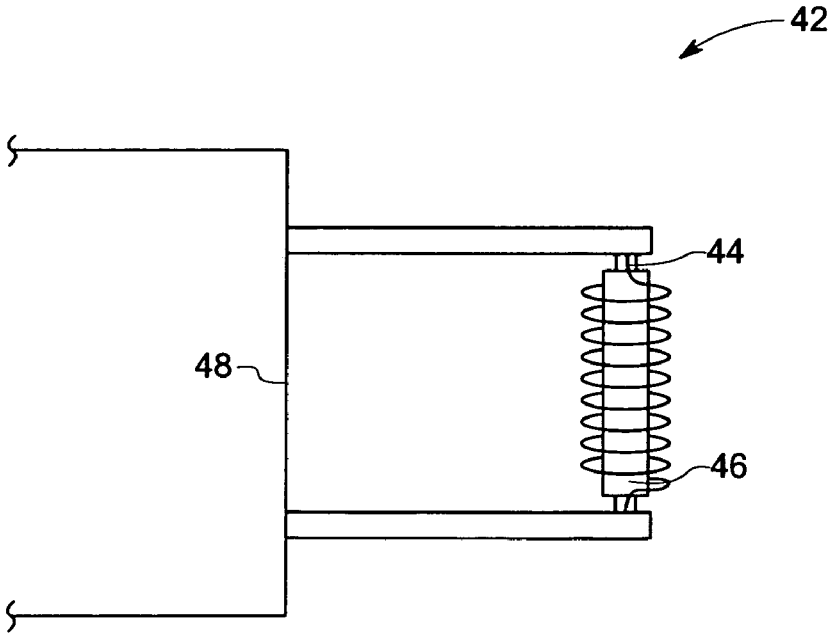
FIG. 6 is a side cross-sectional view of a cathode having a barium-free electron emissive material in accordance with certain embodiments of the present invention.

In the illustrated embodiment shown in FIG. 5, the cathode 34 includes a wire 36 such as a tungsten wire, disposed within a solid composite 38 including the barium-free electron emissive material 38. The cathode may be further coupled to a ballast 40. In the illustrated embodiment shown in FIG. 6, the cathode 42 may include a wire 44 such as a tungsten wire, coiled around a solid composite 46 including the barium-free electron emissive material 46. The cathode may be further coupled to a ballast 48.

Figure 7:
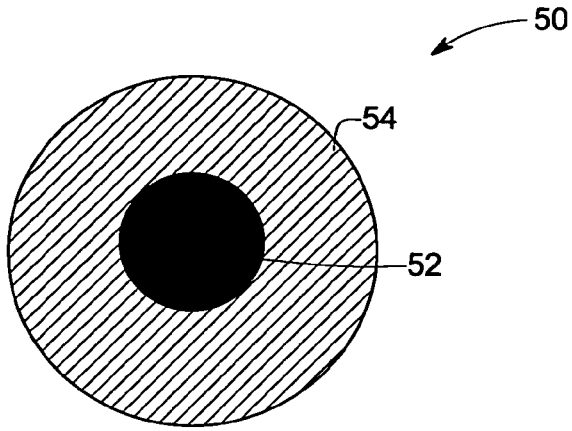
FIG. 7 is a cross-sectional view of a barium-free electron emissive material in accordance with certain embodiments of the present invention.

Further, the barium-free electron emissive materials may be utilized in different forms as shown in FIGS. 7-11. In some electrode embodiments, the barium-free electron emissive material may be present as particles 50 comprising a core material 52 and a shell material 54 as shown in FIG. 7. In a non-limiting example, the core material comprises a metal oxide. In another non-limiting example, the core material comprises a barium-free metal oxide composition.

Figure 8:
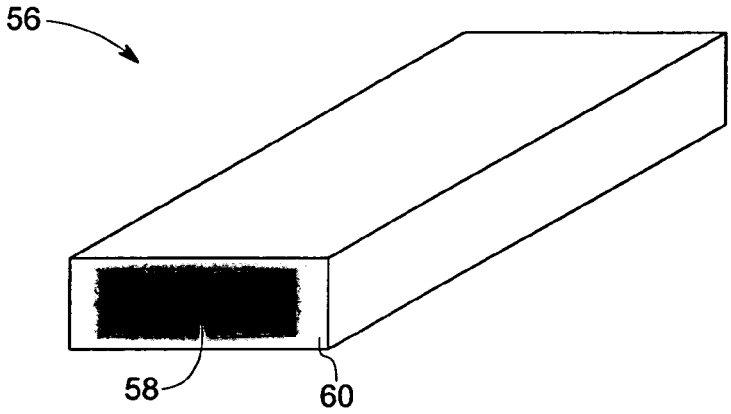
FIG. 8 is a side cross-sectional view of a coating including a barium-free electron emissive material in accordance with certain embodiments of the present invention.

In other electrode embodiments, a barium-free electron emissive material is disposed as a graded composite structure 56 of ceramic and metal as shown in the illustrated embodiment in FIG. 8. In a non-limiting example, the center 58 of the composite structure may be made with greater than 50% metal oxide concentration per unit volume and the outer edges 60 may be made with greater than 50% tungsten metal concentration per unit volume.

Figure 9:
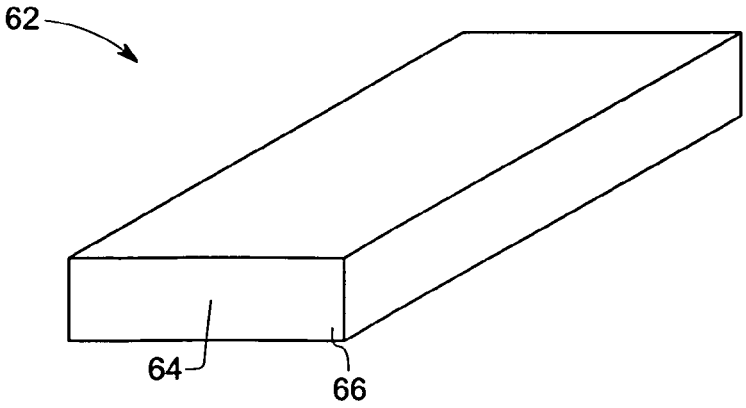
FIG. 9 is a side cross-sectional view of a coating including a barium-free electron emissive material in accordance with certain embodiments of the present invention.

In another embodiment, a barium-free electron emissive material may be disposed on an electrode as a graded sintered ceramic structure 62 as shown in FIG. 9. In a non-limiting example, the metal oxide concentration per unit volume in the sintered ceramic 62 increases radially from the outer edges 64 towards the core 66.

Figure 10:
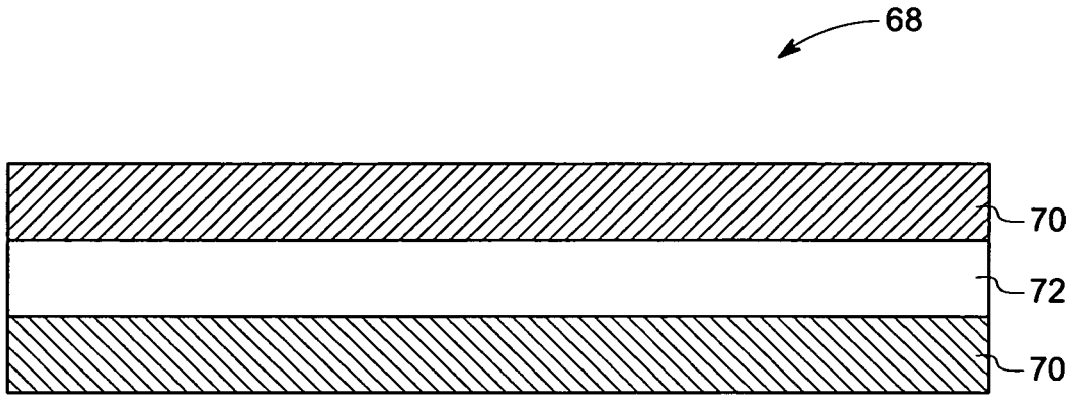
FIG. 10 is a cross-sectional view of a barium-free electron emissive material in accordance with certain embodiments of the present invention.

In still another embodiment of the present invention, an electrode 68 may comprise a multilayered structure as shown in FIG. 10. In a non-limiting example, a low metal oxide content layer 70 alternates with a high metal oxide content layer 72.

Figure 11:
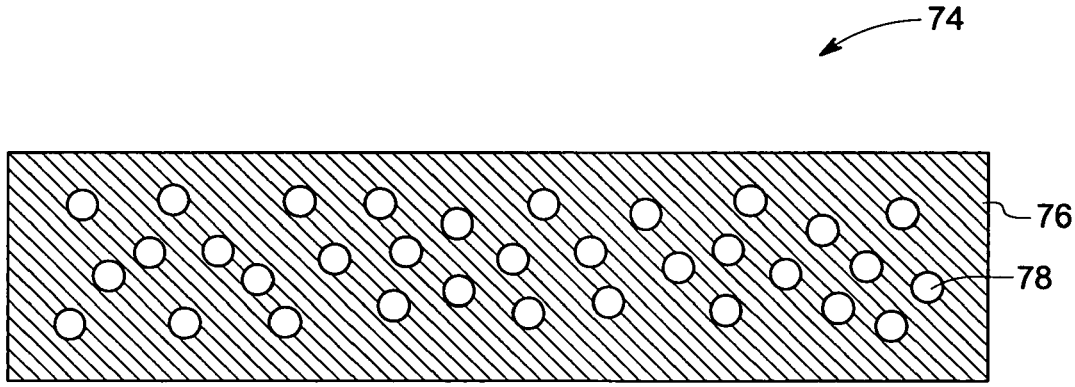
FIG. 11 is a side cross-sectional view of a linear fluorescent lamp employing a barium-free electron emissive material in accordance with embodiments of the present invention.

In yet another embodiment of the present invention as shown in FIG. 11, an electrode 74 may include a barium-free electron emissive material 76 embedded inside the pores of a porous refractory material 78. Refractory materials include but are not limited to tungsten and tantalum.

In one embodiment of the present invention, an electrode including a barium-free electron emissive material may be used in an electric plasma discharge device. Non-limiting examples of electric plasma discharge devices include discharge lamps. In a further embodiment of the present invention, an electrode comprising a barium-free electron emissive material including a metal oxide is disposed within a lamp having an envelope and a discharge material disposed therein. Non-limiting examples of lamps suitable for use in accordance with teachings of the present invention include linear fluorescent lamps, compact fluorescent lamps, circular fluorescent lamps, high intensity discharge lamps, flat panel displays, mercury free lamps or xenon lamps.

Discharge lamps typically include an envelope containing a gas discharge material through which a gas discharge takes place, and typically two metallic electrodes that are sealed in the envelope. While a first electrode supplies the electrons for the discharge, a second electrode provides the electrons with a path to the external current circuit. Electron emission generally takes place via thermionic emission although it may alternatively be brought about by an emission in a strong electric field (field emission), or directly, via ion bombardment (ion-induced secondary emission) or any combination thereof.

Discharge materials may include buffer gases and ionizable discharge compositions. Buffer gases may include material such as but not limited to rare gases such as argon, neon, helium, krypton and xenon, whereas as ionizable discharge compositions may include materials such but not limited to metals and metal compounds. In some embodiments, ionizable discharge compositions may include rare gases. Non-limiting examples of discharge materials suitable for use in a lamp equipped with a barium-free electron emissive material including a barium-free metal oxide composition may include metals, such as but not limited to Hg, Na, Zn, Mn, Ni, Cu, Al, Ga, In, Tl, Sn, Pb, Bi, Ti, V, Cr, Zr, Nb, Mo, Hf, Ta, W, Re, or Os or any combinations thereof. Other discharge materials suitable for use in a lamp equipped with a barium-free electron emissive material also include rare gases such as but not limited to neon and argon. Still other discharge materials include but are not limited to compounds such as halides or oxides or chalcogenides or hydroxide or hydride, or organometallic compounds or any combinations thereof of metals such as but not limited to Hg, Na, Zn, Mn, Ni, Cu, Al, Ga, In, Tl, Ge, Sn, Pb, Bi, Ti, V, Cr, Zr, Nb, Mo, Hf, Ta, W, Re, or Os or any combinations thereof. Non-limiting examples of metal compounds include zinc halides, gallium iodide, and indium iodide. In some embodiments, in metal halide discharge lamps, the metal and halogen may be present in a non-stoichiometric ratio. For example, in a gallium iodide lamp, gallium and halogen may be present in a molar ratio from about 1:3 to about 2:1. In one embodiment, the lamp is a mercury lamp. In another embodiment, the lamp is a mercury free lamp.

In some embodiments the discharge material under steady-state operating conditions may produce a total vapor pressure of less than about $1\times10^5$ pascals. As used herein, the term "steady state operating conditions" refers to operating conditions of a lamp which is in thermal equilibrium with its ambient surroundings, and wherein a majority of radiation from the discharge comes from the ionizable discharge compositions. Typically, the buffer gas pressure during steady-state operation is slightly higher than it was when then lamp was at ambient temperature. Typically, ionizable discharge composition pressure during steady state operation is orders of magnitude higher than it was when the lamp was at ambient temperature, as the vapor pressure depends exponentially on the temperature. In some embodiments, the discharge material under steady-state operating conditions may produce a total vapor pressure in a range from about $2\times10^1$ pascals to about $1\times10^4$ pascals. In some other embodiments, the discharge material under steady-state operating conditions may produce a total vapor pressure in a range from about $2\times10^1$ pascals to about $2\times10^3$ pascals. In some embodiments the discharge material under steady-state operating conditions may produce a total vapor pressure in a range of about $1\times10^3$ pascals. In some embodiments, the partial pressure under steady state operating conditions of the ionizable discharge composition in the discharge material may be less than about $1\times10^3$ pascals. In further embodiments, the partial pressure under steady state operating conditions of the ionizable discharge composition in the discharge material may be in a range from about $1\times10^{-1}$ pascals to about $1\times10^1$ pascals. In a non-limiting example, the discharge material may include argon buffer gas and gallium iodide ionizable discharge composition. At an ambient temperature of 20° C., the total pressure may be about $1\times10^3$ pascals, primarily due to the buffer gas, and the partial pressure of the ionizable discharge composition may be about $1\times10^{-4}$ pascals. At steady state operating condition temperature of 100° C., the total pressure may be about $1.370\times10^3$ pascals and the partial pressure of the ionizable discharge composition may be about 1 pascal. In one embodiment, the lamp is a mercury lamp. In another embodiment, the lamp is a mercury free lamp.

Figure 12:
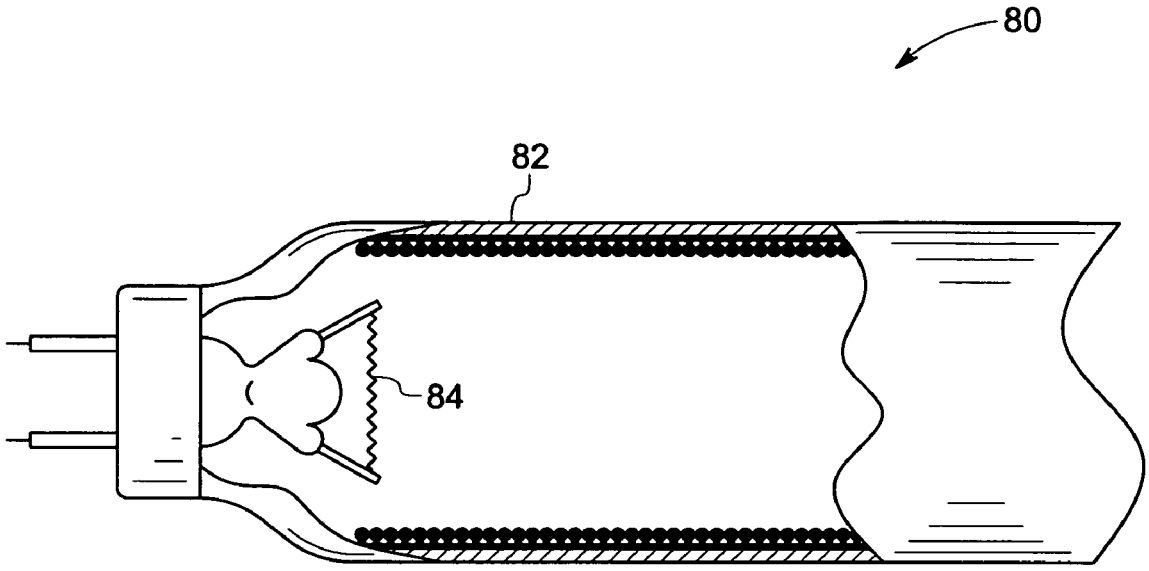
FIG. 12 is a side cross-sectional view of a compact fluorescent lamp employing a barium-free electron emissive material in accordance with embodiments of the present invention.
Figure 13:
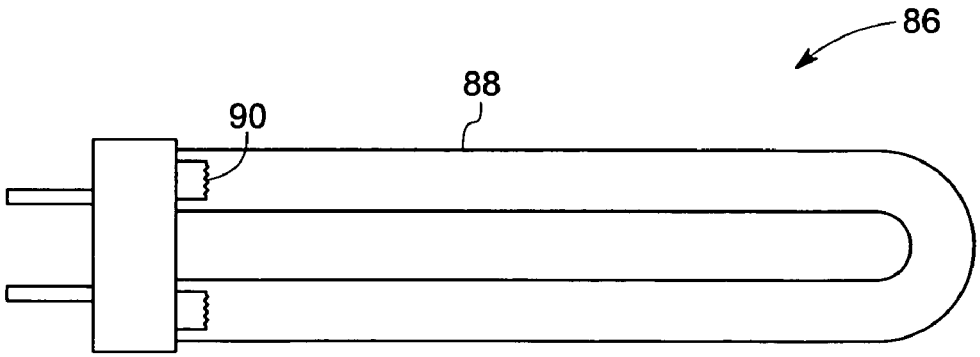
FIG. 13 is a top cross-sectional view of a circular fluorescent lamp employing a barium-free electron emissive material in accordance with embodiments of the present invention.
Figure 14:
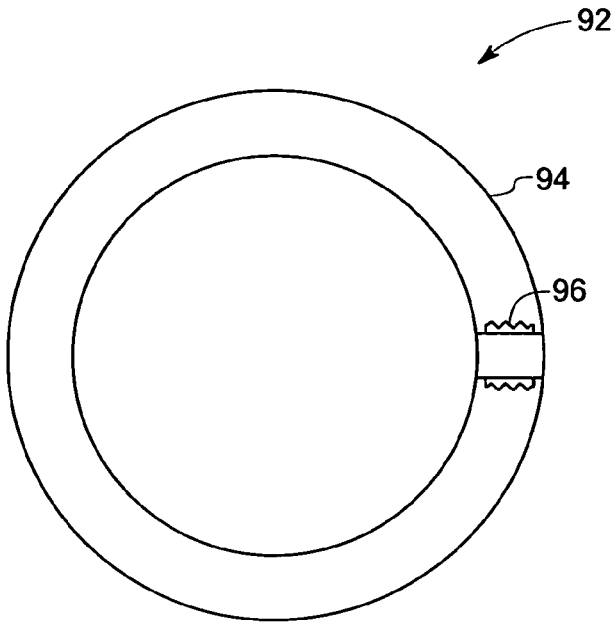
FIG. 14 is a side cross-sectional view of a high pressure fluorescent lamp employing a barium-free electron emissive material in accordance with embodiments of the present invention.
Figure 15:
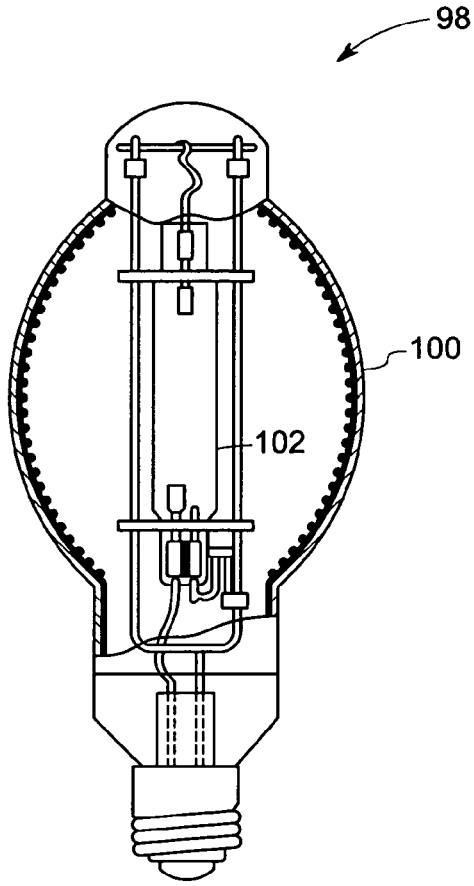
FIG. 15 is a side cross-sectional view of a high-pressure fluorescent lamp employing a barium-free electron emissive material in accordance with embodiments of the present invention.

In some embodiments, a barium-free electron emissive material may be provided in a fluorescent lamp including a cathode, a ballast, a discharge material and an envelope or cover containing the discharge material. The fluorescent lamp may comprise a linear fluorescent lamp 80 as illustrated in FIG. 12 with an envelope 82 and an electrode with the barium-free electron emissive material 84, or a compact fluorescent lamp 86 with an envelope 88 and an electrode with the barium-free electron emissive material 90 as illustrated in FIG. 13. The lamp may also be a circular fluorescent lamp 92 with an envelope 94 and an electrode with the barium-free electron emissive material 96, as illustrated in FIG. 14. Alternatively, the lamp may comprise a high-pressure lamp or high intensity discharge lamp 98, including an arc envelope 102 inside an outer housing 100 as illustrated in FIG. 15.

In some embodiments of the present invention, a barium-free electron emissive material disposed within a lamp is heated until it emits electrons, primarily by thermionic emission, but additional processes such as electric-field-enhanced emission may also contribute to electron emission. The heating may occur by any means, including electrical resistance heating of the substrate, the barium-free electron emissive material is disposed over. Other ways of heating include heating due to discharge plasma in the lamp by means of processes such as but not limited to ion bombardment and ion recombination.

In accordance with still another embodiment of the present invention a method of manufacturing a barium-free electron emissive system is described. The method includes blending a barium-free metal oxide composition with a binder to form a slurry, coating the slurry on a thermal or electrical excitation source or an electrode substrate such as a tungsten filament, and removing the binder. In a non-limiting example, the binder may be removed by firing at a high temperature in an appropriate atmosphere at an optimized heating rate.

A barium-free electron emissive material may be manufactured by various processing methods utilized in the fields of ceramics and metallurgy, which generally permit good control over particle size and crystallinity. Suitable examples of such manufacturing processes are the reactive milling method, sol-gel method, wet chemical precipitation, molten-salt synthesis and mechano-chemical synthesis.

Metal compounds used in the preparation of the barium-free metal oxide composition may be ground up into the desired particle sizes using a combination of shear and compressive forces in devices such as ball mills, Henschel mixers, Waring blenders, roll mills, and the like. The metal compounds may be ground up for a time period effective to produce particles of about 0.4 to about 8 micrometers. In some embodiments, the particle size may be greater than or equal to about 0.8 micrometers. In other embodiments, the particle size may be greater than or equal to about 1 micrometer. In certain other embodiments, the particle size may be greater than or equal to about 1.5 micrometers. Other embodiments may include particles of size less than or equal to about 5 micrometers. Some other embodiments may include particles of size less than or equal to about 5 micrometers.

The powders of the precursor barium-free electron emissive material are generally first mechanically milled, if desired, to provide particles of a desired size. The particles are then blended with a binder and optionally a solvent to form a wet mixture. Mechanical milling may continue during the formation of the wet mixture. The wet mixture as may be a slurry, suspension, solution, paste, or the like. The wet mixture may be then coated onto a desired substrate, following which it is optionally allowed to dry to form a green coating. In some embodiments, the green coating may be a coating which generally has less than or equal to about 10 weight percent solvent based upon the weight of the wet mixture. In some embodiments, less than or equal to about 5 weight percent solvent may be present. In some other embodiments, less than 3 weight percent solvent may be present. In certain embodiments, less than or equal to about 2 weight percent solvent based on the total weight of the wet mixture may be present. The substrate with the coating may be annealed to facilitate the sintering of the coating to form the barium-free electron emissive material. In one embodiment, a composite comprising a barium-free electron emissive material can be disposed as a thin or a thick film on a tungsten substrate through a sol-gel process or other physical and/or chemical thin-film deposition methods.

Binders used in the preparation of the mixture typically are polymeric resins, ceramic binders, or combinations comprising polymeric resins and ceramic binders. Non-limiting examples of ceramic binders are aluminum phosphate ($AlPO_4$), silica ($SiO_2$), and magnesia (MgO). Polymeric resins used in the preparation of the wet mixture may be thermoplastic resins, thermosetting resins or combinations of thermoplastic resins with thermosetting resins. The thermoplastic resins may be oligomers, polymers, copolymers such as block copolymers, graft copolymers, random copolymers, star block copolymers, dendrimers, polyelectrolytes, ionomers or the like, or combinations comprising at least one of the foregoing thermoplastic resins. Suitable examples of thermoplastic resins are polyacetal, polyacrylic, styrene acrylonitrile, acrylonitrile-butadiene-styrene (ABS), polycarbonates, polystyrenes, polyethylene, polypropylenes, polyethylene terephthalate, polybutylene terephthalate, polyamides, polyamideimides, polyarylates, polyurethanes, polyetherimide, polytetrafluoroethylene, fluorinated ethylene propylene, perfluoroalkoxy polymers, polyethers such as polyethylene glycol, polypropylene glycol, or the like; polychlorotrifluoroethylene, polyvinylidene fluoride, polyvinyl fluoride, polyetherketone, polyether etherketone, polyether ketone ketone, nitrocellulose, cellulose, lignin, or the like, or combinations comprising at least one of the foregoing thermoplastic resins. In certain embodiments thermoplastic resin may be nitrocellulose.

It is generally desirable to use thermoplastic resins having a number average molecular weight of about 1000 grams per mole (g/mole) to about 500,000 g/mole. Within this range, it may be desirable to use a thermoplastic resin having a number average molecular weight of greater than or equal to about 2,000. In certain embodiments the number average molecular weight may be greater than or equal to about 3,000. In certain other embodiments, the number average molecular weight may be greater than or equal to about 4,000 g/mole. In some embodiments, the number average molecular weight may be less than or equal to about 200,000. In other embodiments, the number average molecular weight may be less than or equal to about 100,000. In still other embodiments, the number average molecular weight may be less than or equal to about 50,000 g/mole.

Examples of blends of thermoplastic resins include acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polycarbonate/thermoplastic urethane, polycarbonate/polyethylene terephthalate, polycarbonate/ polybutylene terephthalate, polyethylene terephthalate/polybutylene terephthalate, styrene-maleicanhydride/ acrylonitrile-butadiene-styrene, polyethylene/nylon, polyethylene/polyacetal, or the like, or combinations comprising at least one of the foregoing blends of thermoplastic resins.

Specific non-limiting examples of polymeric thermosetting materials include polyurethanes, epoxy, phenolic, polyesters, polyamides, silicones, or the like, or combinations comprising at least one of the foregoing thermosetting resins.

Ceramic binders may also be used in the preparation of the wet mixture. Examples of ceramic binders are aluminum phosphate, zirconia, zirconium phosphate, silica, magnesia and the like. In some embodiments, binders may be used in an amount of about 5 weight percent, to about 50 weight percent based on the total weight of the wet mixture. In certain embodiments, binders may be generally present in the wet mixture in an amount of greater than or equal to about 8 weight percent. In other embodiments, binders may be present in an amount greater than or equal to about 10 weight percent. In still other embodiments, binder may be present in an amount greater than or equal to about 12 weight percent based on the total weight of the wet mixture. Some other embodiments, include binders present in the wet mixture in an amount of less than or equal to about 45 weight percent. In certain embodiments, binders may be present in an amount less than or equal to about 40 weight percent. In yet other embodiments, binders may be present in an amount less than or equal to about 35 weight percent based on the total weight of the wet mixture.

Solvents may optionally be used in the preparation of the wet mixture. Liquid aprotic polar solvents such as propylene carbonate, ethylene carbonate, butyrolactone, acetonitrile, benzonitrile, nitromethane, nitrobenzene, sulfolane, dimethylformamide, N-methylpyrrolidone, butyl acetate, amyl acetate, methyl propanol or propylene glycol mono-methyl ether acetate with denatured ethanol, or the like, or combinations comprising at least one of the foregoing solvents may generally be used in the preparation of the wet mixture. Polar protic solvents such as water, methanol, acetonitrile, nitromethane, ethanol, propanol, isopropanol, butanol, or the like, or combinations comprising at least one of the foregoing polar protic solvents may also be used in the preparation of the wet mixture. Other non-polar solvents such a benzene, toluene, methylene chloride, carbon tetrachloride, hexane, diethyl ether, tetrahydrofuran, or the like, or combinations comprising at least one of the foregoing solvents may also be used in the preparation of the wet mixture. Co-solvents comprising at least one aprotic polar solvent and at least one non-polar solvent may also be utilized to prepare the wet mixture. Ionic liquids may also be utilized for preparing the wet mixture. In some embodiments, the solvent may be bepropylene glycol mono-methyl ether acetate with denatured ethanol. In a non-limiting example, the solvent comprises about 90 weight percent to about 95 weight percent of propylene glycol mono-methyl ether acetate with about 1 weight percent to about 2 weight percent of the denatured alcohol.

The solvent is generally used in an amount of about 5 weight percent to about 60 weight percent based on the total weight of the wet mixture. Within this range, the solvent is generally present in the wet mixture in an amount of greater than or equal to about 8 weight percent. In some embodiments, the solvent may be present in an amount greater than or equal to about 10 weight percent. In other embodiments, the solvent is present in an amount greater than or equal to about 12 weight percent based on the total weight of the wet mixture. Within this range, the solvent may be generally present in the wet mixture in an amount of less than or equal to about 48 weight percent. In some embodiments, the solvent may be present in an amount less than or equal to about 45 weight percent. In certain embodiments, the solvent may be present in an amount less than or equal to about 40 weight percent based on the total weight of the wet mixture.

The wet mixture may be generally coated onto a desired substrate such as a tungsten wire or sheet and then sintered. The coating of the substrate may be carried out by processes such as dip coating, spray painting, electrostatic painting, painting with a brush, or the like. In one embodiment, a barium-free electron emissive material coating thickness may be from about 3 micrometers to about 100 micrometers after sintering. In another embodiment, the coating thickness may be from about 10 micrometers to about 80 nanometers. In a still another embodiment, the coating thickness may from about 15 micrometers to about 60 micrometers.

The coated substrate may be generally subjected to a sintering process to remove the solvent and binder and to form a coating of the barium-free electron emissive material on the substrate. The sintering process may be conducted by heating process such as conduction, convection, radiation such as radio frequency radiation or microwave radiation. In another embodiment, the electrode may be resistively heated to sinter the wet mixture to form the barium-free electron emissive material. Combinations of different methods of heating for purposes of sintering, such as, for example, convective heating in combination with resistive heating may also be used if desired. The sintering process by conduction, convection, radiation, resistive heating or combinations thereof may be carried out at a temperature of about 1000 ° C. In certain embodiments of the present invention, the sintering may be conducted in a two-stage process if desired. In the first stage the binder may be eliminated by heating the green coating to a temperature of about 300° C. to about 400° C. for about 10 to about 60 minutes. In the second stage the material may be sintered to a temperature of about 1000° C. to about 1700° C.

In another embodiment, the coating of barium-free electron emissive material is subjected to activation. Typically there are two steps to activation. In a first step, a precursor material such as a carbonate may be converted into an oxide by a decomposition process. Carbonate precursors are typically used because of ease of handling as alkaline-earth oxides react with moisture in the air. The decomposition step is followed by the activation step. The activation step typically reduces the material slightly, and creates the semi conducting state and is typically carried out by heating the substrate with the coating through a sequence of successively higher temperatures. In a non-limiting example, an electrode with the coating may be disposed on a mount, and the mount may be sealed into the ends of a lamp tube, the gas inside the tube is removed by a vacuum pump through a tubulation, the electrodes are heated through a time-temperature schedule while continuing to pump away the reaction products of chemical decomposition. In some embodiments, the time-temperature schedule might include further steps to do the activation or reduction to the semiconducting state. The dosing material may then be added into the volume (rare-gas, solid pills, liquid drops, etc), and the tubulation is sealed to create a hermetic lamp tube. During this whole time the tube may be heated to drive water and other impurities off the walls. The decomposition-activation steps may be done in vacuum tubes. In a second step, the coated material may be processed to a state required for electron emission, typically leading to creation of a semiconductor material from an insulating metal, for example by slight reduction of the material, as well as the formation of an initial monolayer surface. In some embodiments, glass capsules containing a dosing material, such as mercury, may be placed inside the lamp assembly and once the whole lamp assembly is sealed, the capsule is broken inside the lamp with measures such as radio frequency heating to release the dosing material.

The substrate may have any desired shape. It may be 1-dimensional, 2-dimensional or 3-dimensional or any suitable fractional dimension up to about 3. Suitable examples of 1 dimensional substrate are linear filaments, non-linear filaments such as circular filaments, elliptical filaments, coiled filaments or the like. Suitable examples of 2-dimensional substrates are flat plates, flat or curved sheets, and the like. Suitable examples of 3-dimensional substrates are hollow spheres, cups, beads, and the like. It may also be possible to use substrates having a combination of 1, 2, or 3-dimensional geometries. Non-limiting example of a substrate is a tungsten filament. In one embodiment, the substrate may be an electrode in a lamp. The electrode may be an anode, a cathode, or both an anode and a cathode in a lamp.

In another embodiment, a barium-free metal oxide composition, and tungsten powders may be sintered to a high density and used as a composite sintered electrode. Such a composite sintered electrode may desirably offer significant flexibility in the positioning of the cathode within the lamp and allows lamp design flexibility such as fluorescent tubes of narrower diameter.

In some embodiments, providing a barium-free electron emissive material includes providing an impregnated electrode. The barium-free electron emissive material may be embedded into the pores of a porous refractory metal such as tungsten or tantalum.

In a still further embodiment of the present invention is a method including thermally or electrically exciting a barium-free electron emissive material including a barium-free metal oxide composition disposed within a lamp, by operably coupling the lamp to an excitation source such as an electrode substrate and supplying thermal or electrical energy to cause the barium-free electron emissive material to emit electrons. A non-limiting example of energizing the excitation source may be by coupling to an alternating current (AC) or direct current (DC) power supply. In a non-limiting example, a calcium oxide electron emissive material may be used in an indium iodide discharge material lamp.

Due at least in part to the barium-free nature of the various barium-free metal oxide compositions described herein, degradation of metal halide discharge materials in metal halide lamps can be reduced or altogether avoided. The barium-free metal oxide compositions have low work-function, compared to other materials that are stable in the presence of halogen vapor. Further, the barium-free metal oxide compositions are also environmentally less toxic compared with other compositions such as thorium oxide (radioactive), which also may be stable in halogen vapor.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A lamp comprising:

an envelope;

a barium-free electrode comprising a barium-free electron emissive material, wherein the barium-free electron emissive material comprises at least one barium-free metal oxide composition operable to emit electrons in response to a thermal excitation, wherein the metal oxide comprises strontium oxide, wherein the thermal excitation is provided substantially by a plasma discharge; and a discharge material contained within the envelope, wherein the discharge material under steady-state operating conditions produces a total vapor pressure in a range from about $2\times10^{1}$ Pascals to about $1\times10^{3}$ Pascals.

2. The lamp of claim 1, wherein the discharge material comprises at least one material selected from the group consisting of metals, Hg, Na, Zn, Mn, Ni, Cu, Al, Ga, In, Tl, Sn, Pb, Bi, Ti, V, Cr, Zr, Nb, Mo, Hf, Ta, W, Re, Os, rare gases, Ne, Ar, He, Kr, Xe and combinations thereof.

3. The lamp of claim 1, wherein the discharge material comprises at least one material selected from the group consisting of metal compounds, compounds of (include Na, Zn) Mn, Ni, Cu, Al, Ga, In, Tl, Ge, Sn, Pb, Bi, Ti, V, Cr, Zr, Nb, Mo, Hf, Ta, W, Re, Os, and combinations thereof, wherein said compound is selected from the group consisting of halides, oxides, chalcogenides, hydroxide, hydride, organometallic compounds and combinations thereof.

4. The lamp of claim 1, where in the discharge medium comprises at least one material selected from the group consisting of gallium iodide, zinc iodide and indium iodide.

5. The lamp of claim 1, wherein the lamp comprises one selected from the group consisting of a linear fluorescent lamp, compact fluorescent lamp, a circular fluorescent lamp, a high intensity discharge lamp, a flat panel display, a mercury free lamp and a xenon lamp.

6. The lamp of claim 1, wherein the electrode is operable to emit electrons in the absence of external heating.

7. The lamp of claim 1, wherein thermal electron emission due to the plasma discharge is substantially greater than secondary electron emission.

8. The lamp of claim 1, wherein strontium oxide is present in a quantity greater than about 20% by weight of the total barium-free metal oxide composition.

9. The lamp of claim 1, wherein strontium oxide is present in a quantity greater than about 50% by weight of the total barium-free metal oxide composition.

10. The lamp of claim 1, wherein strontium oxide is present in a quantity greater than about 80% by weight of the total barium-free metal oxide composition.

11. The lamp of claim 1, wherein the barium-free metal oxide composition comprises a solid solution of two or more metal oxides.

12. The lamp of claim 1, wherein the barium-free metal oxide composition is disposed as a coating over a substrate.

13. The lamp of claim 1, wherein the at least one barium-free metal oxide composition further comprises magnesium oxide, calcium oxide or combinations thereof.

* * * * *